US006705515B2

(12) United States Patent
Dowd

(10) Patent No.: US 6,705,515 B2
(45) Date of Patent: Mar. 16, 2004

(54) SELF ERECTING AND COLLAPSIBLE CORRUGATED PLASTIC BOX

(75) Inventor: Fred Dowd, Princeton, MA (US)

(73) Assignee: Technology Container Corp.

( * ) Notice: Subject to any disclaimer, the term of this patent is extended or adjusted under 35 U.S.C. 154(b) by 0 days.

(21) Appl. No.: 10/176,329

(22) Filed: Jun. 20, 2002

(65) Prior Publication Data

US 2003/0234283 A1 Dec. 25, 2003

(51) Int. Cl.[7] ..... B65D 5/00

(52) U.S. Cl. ..... 229/182; 229/185; 229/939; 229/198.2

(58) Field of Search ..... 229/939, 185, 229/182, 117, 117.01, 198.2, 164

(56) References Cited

U.S. PATENT DOCUMENTS 2,833,459 A * 5/1958 Greene ..... 229/939 X
3,076,589 A * 2/1963 Meijdam ..... 229/939 X
3,342,322 A * 9/1967 Weisner et al. ..... 229/939 X
4,530,460 A * 7/1985 Hinton ..... 229/939
4,572,425 A * 2/1986 Russell ..... 229/939 X
5,363,981 A * 11/1994 Giblin et al. ..... 229/933
6,024,223 A 2/2000 Ritter
6,102,279 A 8/2000 Dowd
6,102,280 A 8/2000 Dowd
6,189,780 B1 * 2/2001 Kanter ..... 229/242
6,257,484 B1 7/2001 Dowd
6,349,876 B1 2/2002 Dowd

* cited by examiner

*Primary Examiner*—Tri M. Mai
(74) *Attorney, Agent, or Firm*—Todd S. Parkhurst; Holland & Knight LLP

(57) ABSTRACT

A corrugated plastic box is disclosed. The box is provided with an L-shaped or chair-shaped end panel which can be adhesively secured to a box side panel. The end panel has a lower portion which extends over a relatively great number of box side corrugations, and an upper panel portion which extends over fewer box side corrugations, so as to spread interior box loads across a number of corrugations and inhibit box side bowing. The box sides are also strengthened by providing upper panels which are rolled over along the top edges of the box, the panels are then food or otherwise fastened to the side panels. The rolled-over top edges thus formed strengthen the box, and prevent the entry of contaminants into the otherwise-exposed side panel corrugation flutes. The box is provided with a number of specially shaped box bottom panels which enable the box to be quickly and easily erected by even inexperienced personnel. After the box has been emptied, the box can be quickly and easily knocked flat and returned to a box filling point for reuse. Considerable labor and box material savings can be realized.

5 Claims, 5 Drawing Sheets

SELF ERECTING AND COLLAPSIBLE CORRUGATED PLASTIC BOX

This invention pertains to collapsible boxes, and more particularly concerns a collapsible and self erecting box made of corrugated plastic.

Collapsible corrugated plastic boxes are disclosed and claimed in U.S. Pat. Nos. 6,102,279; 6,102,280; 6,257,484; and 6,349,876. The material used to make the box of the present invention can be made in conformance with those disclosures, and the fold line/score line configurations, handholds and automatically lockable bottom panel arrangements can be provided, if desired, in accordance with the disclosures in the cited patents.

It is an object of this invention to provide a reusable plastic container box for materials such as bags of frozen foods which can be quickly erected, used repeatedly over a long period of time without appreciable deterioration or wear, and quickly knocked flat for shipment back to an original box filling point.

It is another object of the invention to provide a reusable plastic container box in which at least one of the sides is especially strengthened against damaging deformation or bowing.

Other objects and advantages of the invention will become apparent upon reading the following detailed description and upon reference to the drawings. Throughout the drawings, like reference numerals referred to like parts.

DETAILED DESCRIPTION

While the invention will be described in connection with a preferred embodiment and procedure, it will be understood that it is not intended to limit the invention to this embodiment or procedure. On the contrary, it is intended to cover all alternatives, modifications and equivalents as may be included within the spirit and scope of the invention as defined by the appended claims.

Figure 1:
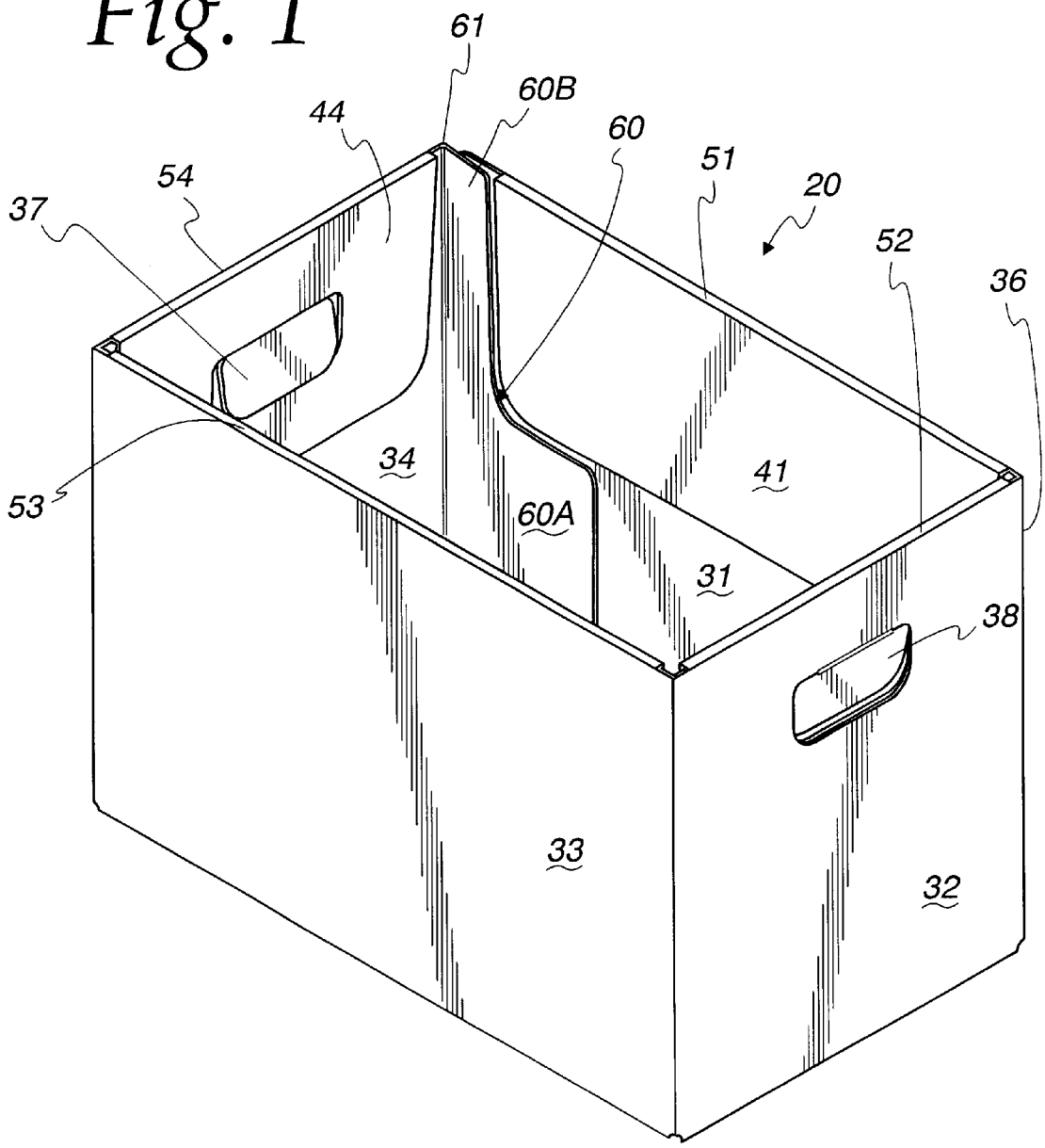
FIG. 1 is an isometric view of a plastic corrugated box made in accordance with the present invention.

Turning first to FIG. 1, there is shown an erected box 20 which can be used for transporting a wide variety of objects such as, for example, bags of frozen vegetables, horticultural products, snack foods, soft goods, paper goods or a whole host of other items, products or things. The box 20 can be referred to as a Merchandising Unit (MU). For example, this MU or box 20 can be used to transport bags of frozen vegetables from a freezer or frozen storage facility to the frozen food display shelves of a grocery store, but it will be understood that it is not intended to so limit this invention in its use. Because the box is constructed of sturdy corrugated plastic material, it can be knocked down into a flattened configuration, returned to a box packing point, re-erected, and used again.

Figure 2:
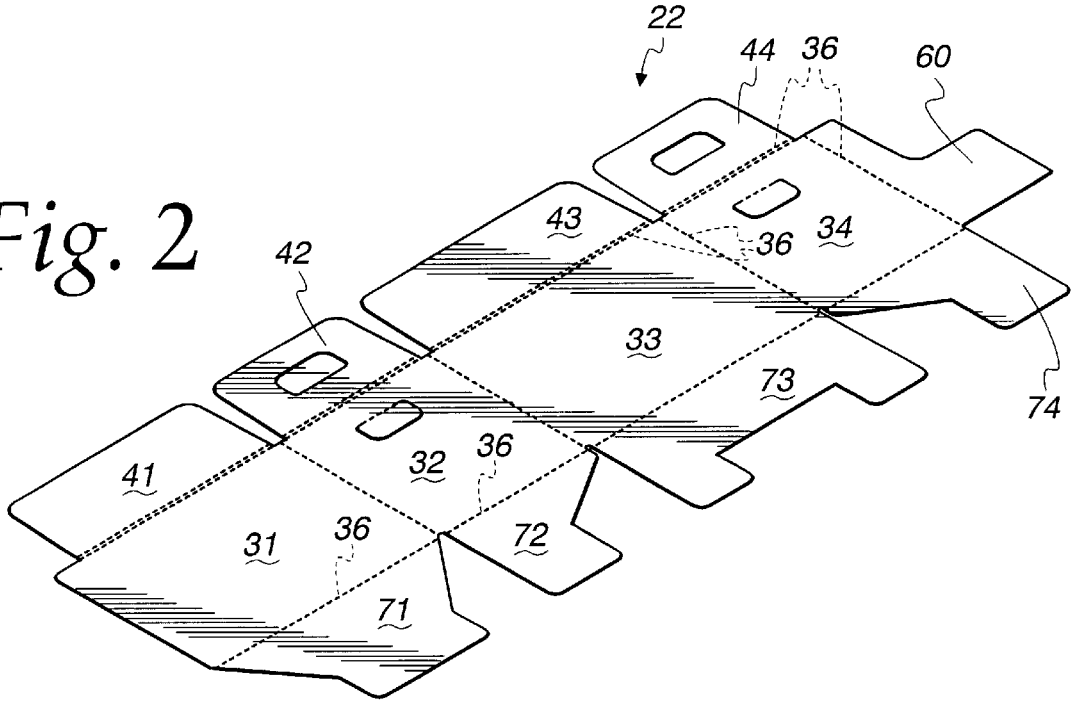
FIG. 2 is an isometric view of a planar plastic blank from which the box shown in FIG. 1 can be made.

The unitary blank 22 from which this box 20 can be made is shown in FIG. 2. Suitable polypropylene, polystyrene, polyvinyl chloride, polyethylene, or even corrugated paper or other material can be used to form the blank. Panels 31, 32, 33, and 34 which will become respective box sides are defined on and in the blank 22 by various hinge or score lines 36. These score lines 36 can be created in and on the corrugated plastic blank 22 as suggested in the above referenced U.S. Pat. No. 6,102,279, or in other known ways.

Figure 10:
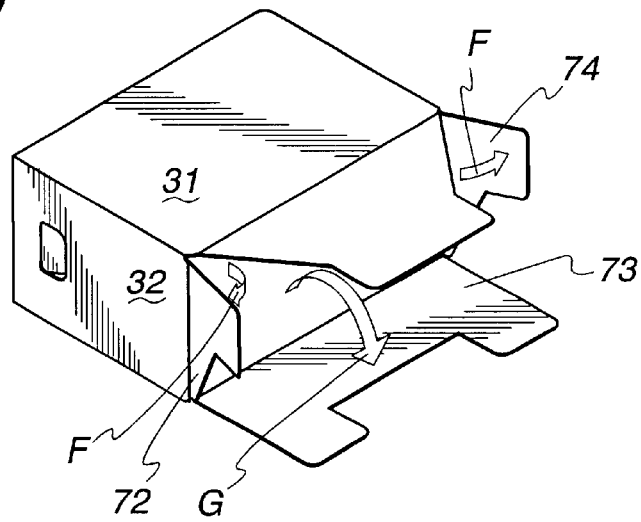
FIG. 10 is an isometric view similar to FIGS. 7–9 illustrating final steps involved in the unfolding the bottom flaps from an erected box so as to permit the box to be flattened into a knocked-down configuration.

Handholds and handhold openings 37 and 38 can be provided in the end walls 32 and 34 as shown in FIGS. 1–4 and as indicated in U.S. Pat. No. 6,102,279. The flaps from which these and openings 37 and 38 are constructed can be full flap cutouts, comprising the entire material as suggested in FIG. 10 of that '279 patent, or they can be less than full flaps, constructed by removing a portion of the material which would otherwise be included in the flat.

Figure 3:
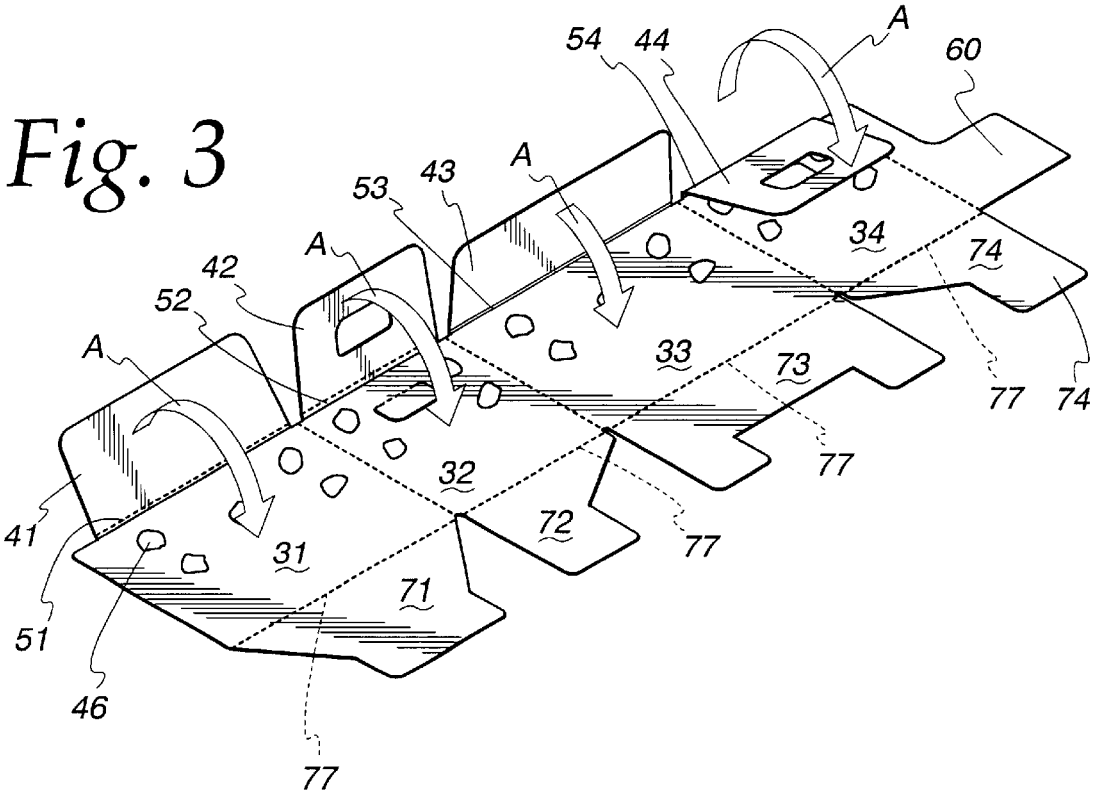
FIG. 3 is an isometric view similar to FIG. 2 suggesting initial steps in the making of the box blank shown in FIG. 2 into the box shown in FIG. 1.

To permanently assemble a box blank 22 into a box 20, upper panels 41, 42, 43 and 44 are first folded over against the respective inner surfaces of the side panels 31–34 as suggested in FIG. 3 by arrows A; and the panels 41–44 are permanently secured to the inner surfaces of the box side panels 31–34 by suitable spots 46 of adhesive or other known means.

This step and arrangement of the upper panels 41–44 provides strong, smooth vertical box sides and strong, smooth top horizontal edges 51, 52, 53, and 54. These rolled-over edges 51–54 provide several advantages and features of the invention. First, the rolled-over edges 51 1–54 obviate any danger that a customer or box user might be scratched by inadvertently rubbing against the rough, open, exposed top edges which would otherwise be presented. In addition, the rolled-over edges 51–54 provide additional structural rigidity along the top of all four sides of the box. In further accordance with the invention, the rolled-over top edges 51–54 prevent dirt and contaminants from migrating into the otherwise opened and exposed flutes of the corrugated plastic or other material forming the box from migrating into the corrugation flutes. If the box should need to be cleaned, the rolled over edges allow box cleaning without water getting into the flutes from the top of the box. This is especially important if the box is to be used as a freezer box, since water trapped within the flutes might later freeze and expand, thereby damaging or splitting the box corrugation and sides.

Figure 4:
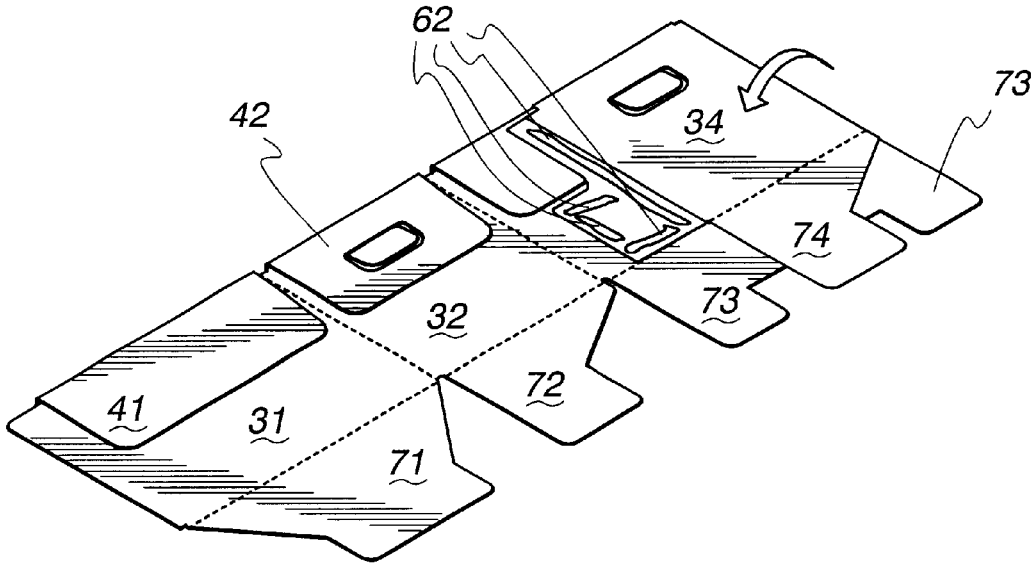
FIG. 4 is an isometric view similar to FIGS. 2 and 3 suggesting further steps involved in the making of the box blank shown in FIG. 2 into the box shown in FIG. 1.
Figure 5:
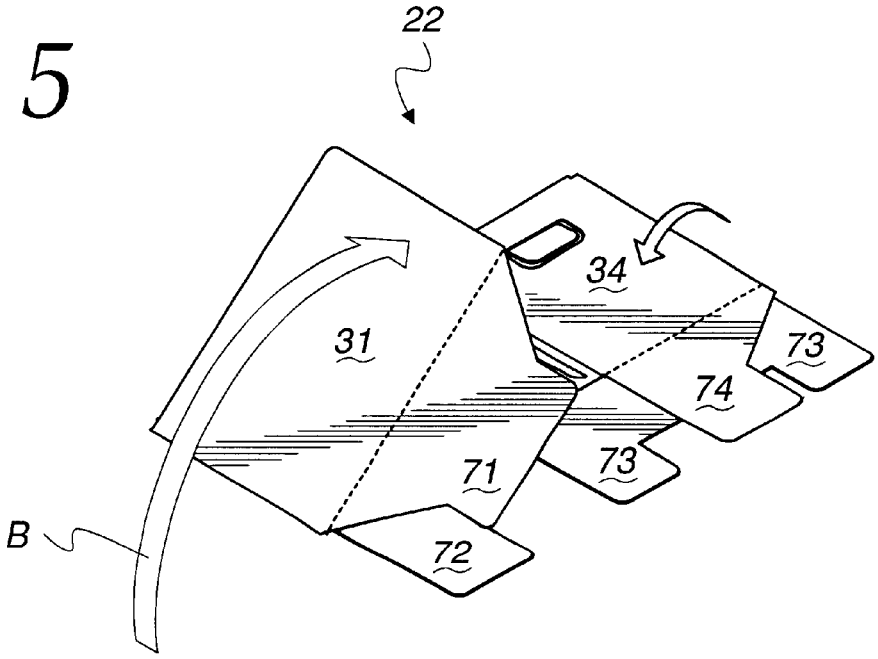
FIG. 5 is an isometric view similar to FIGS. 2–4 suggesting further steps involved in the making of the box blank shown in FIG. 2 into the box shown in FIG. 1.

The box panels are next folded along the score lines 36 into the configuration indicated in FIGS. 4 and 5.

In accordance with the invention, an L-shaped or chair-shaped glue flap or end panel 60 (FIGS. 2 and 3) is attached, at a glue flap score or hinge line 61, to one end wall panel 34, and when the box is assembled, that glue flap or panel 60 is secured by adhesive 62 or other known means to a side wall panel 31 which is located at the opposite end of the blank 22, as suggested in FIGS. 2 and 3.

It will be noted that the top panel 41 has a horizontal length somewhat less than the wall panel 31 to which it is attached, so that it will closely internest with the upper portion 60A and the lower portion 60B of the adjacent glue flap panel 60, as shown particularly in FIG. 1. When the blank is so assembled, the four side walls 31, 32, 33 and 34 are each attached to the adjacent side walls along two end creases or hinges 36, as can be envisioned by comparing FIGS. 1, 5 and 6.

The box thus created is sturdy, yet inexpensive. In accordance with an aspect of the invention, cracking, bowing, folding, tearing or bending of side wall 31 is discouraged by the L or chair shape of the glue flap end panel 60 when that flap 60 is glued to the side wall 31, because the side wall lower portion 60A is extended across a relatively great number of the corrugations of that corrugated side wall 31; and because the upper portion of the side of flat 60B extends across a relatively few of the side wall corrugations, as can be seen especially in FIG. 1. During box use, interior loads which tend to bow the side wall 31 are thus spread across a relatively great number of corrugations of the side wall 31, and are not concentrated at any one corrugation. By avoiding the concentration of bowing forces at any one un-reinforced corrugation, bowing action and box side mis-folding is avoided. If the box blank were to mis-folded along a particular corrugation, the box might not erect correctly, and might jam automatic box set up equipment.

Additional and cooperating anti-cracking and anti-bowing support for the side walls 31–34 is provided by the upper flaps 41–44 when they are glued to the side walls 31–34 as suggested in FIG. 3 and as described above. As suggested above and in FIG. 1, the flap 41 is sized and shaped so as to internest with the flap 60, so that substantially complete horizontal support is provided across each of the side walls 31–34.

Figure 6:
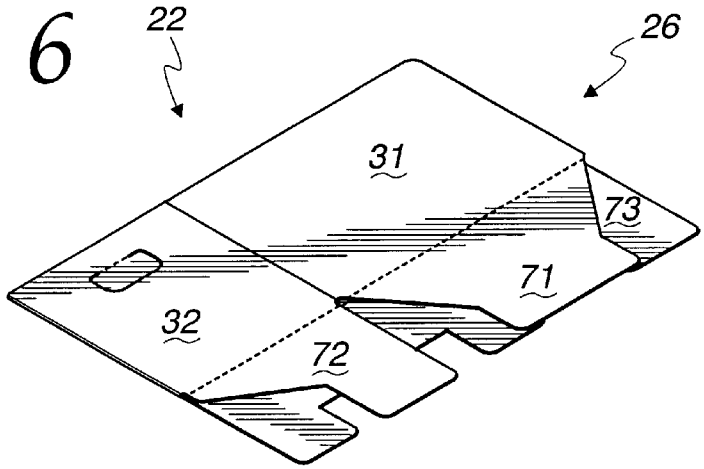
FIG. 6 is an isometric view similar to FIGS. 2–5 suggesting later steps involved in the making of the box blind shown in FIG. 2 into the box shown in FIG. 1.

After the flap 60 is attached, the side panel 31 is then folded over the blank 22 as indicated by arrow B in FIG. 5, resulting in a finished box flat 26 as shown in FIG. 6.

Figure 7:
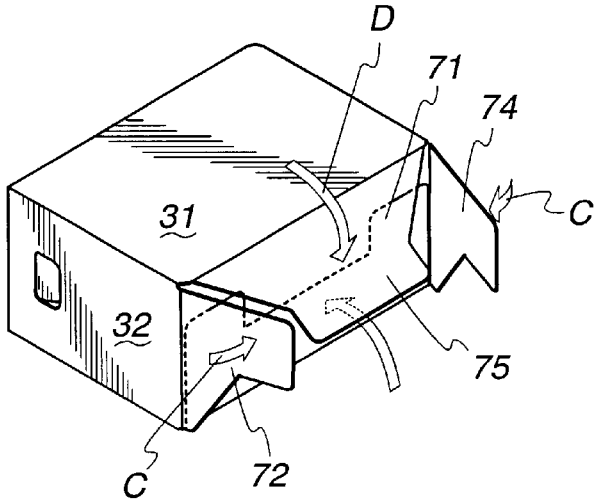
FIG. 7 is an isometric view similar to FIGS. 2–6 illustrating the erection of the box and the preliminary folding steps involved in creating and securing the box bottom.
Figure 8:
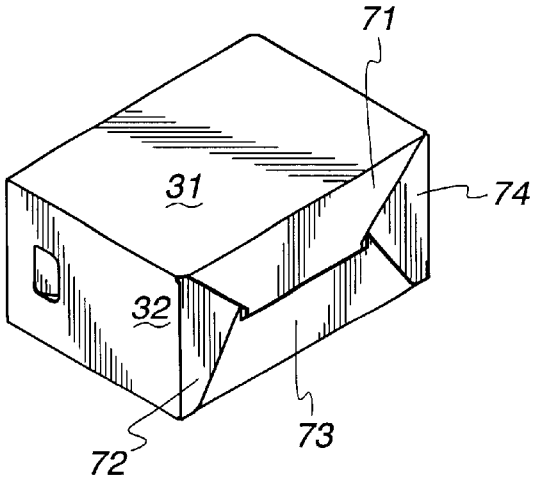
FIG. 8 is an isometric view similar to FIGS. 2–7 illustrating the final steps involved in creating and securing the box bottom and completing the erection of the box.

Erection of the box flat 26 into a three-dimensional box is easily accomplished as suggested in FIGS. 7 and 8. As shown in FIGS. 2 and 3, each of the panels 31–34 has a depending bottom flap 71, 72, 73 and 74, and each of these depending bottom flaps can be folded along the score/hinge lines 77. To create a sturdy but reconfigurable bottom, flat 73 is first folded upwardly as suggested in FIG. 8. Flaps 72 and 74 are folded horizontally inwardly as suggested by arrows C in FIG. 7. Finally, flap 71 is folded downwardly as suggested by arrow D in FIG. 7. The flap 71 is then pushed further downwardly and inwardly until a distal tongue 75 is extended through the slot created by the four flaps 71, 72, 73 and 74 as suggested in FIG. 8, thereby locking all four flaps 71–74 in place as shown in FIG. 8. Easily followed instructions can be provided by imprinting the legends "fold first" on flap 73; "fold second" on flaps 72 and 74; and "fold third" on flap 71.

Figure 9:
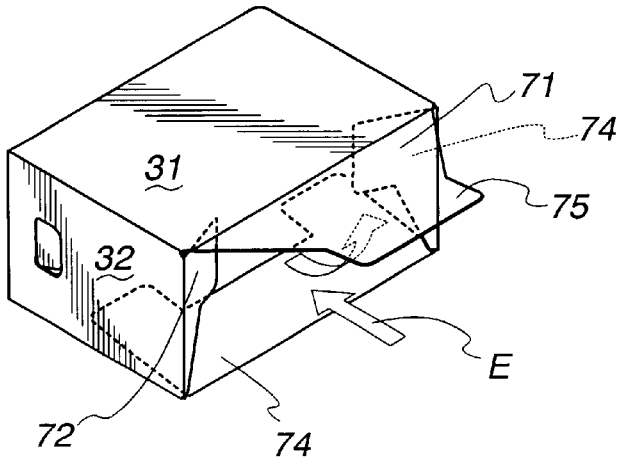
FIG. 9 is an isometric view similar to FIGS. 7 and 8 illustrating preliminary steps involved in unfolding the bottom flaps from an erected box so as to permit the box to be flattened into a knocked-down configuration.
Figure 11:
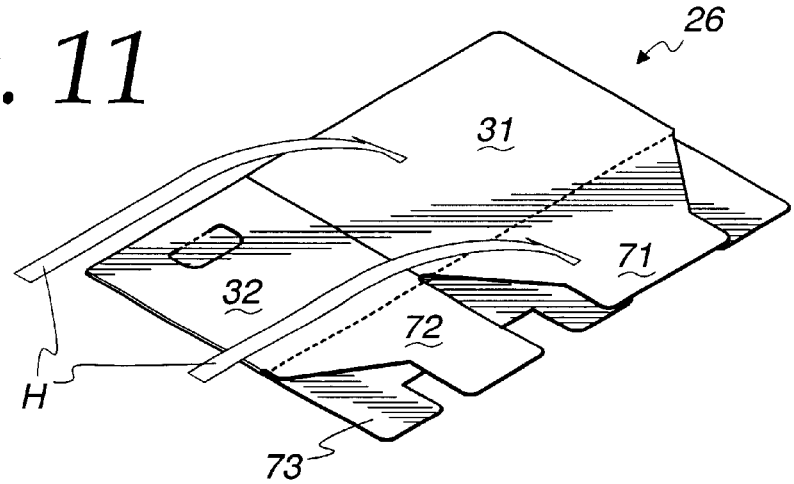
FIG. 11 is an isometric view similar to FIGS. 2–10 illustrating the final steps involved in flattened flattening the box blank as to permit the box in its knocked-down configuration to be easily and economically shipped for another cycle of use or other purposes.

In accordance with another aspect of the invention, the erected box shown in FIGS. 8 and 9 can be easily and quickly "knocked flat" back into the flat configuration 26 shown in FIGS. 6 and 11. As shown in FIG. 9, this can be accomplished by first pushing inwardly on the flap 71 in the direction of arrow E. this action, when completed, frees all four flaps from engagement with the other flaps. Thereafter, the flaps 72 and 74 can be folded outwardly as suggested in FIG. 10 by arrows F, and flap 73 and then be folded outwardly as suggested by arrow G. Next, the original flap 71 can be folded outwardly from its temporary position inside the box cavity. The box can then be "knocked flat" into a flattened configuration by simply pushing on the sides 32 and 31 as suggested by arrows H in FIG. 11. If desired, starting instructions for this collapsing reconfiguration procedure can be provided by including a suitable legend such as "collapse box flat for return by pushing bottom panel number three inward" on any suitable side wall 31–34.

In accordance with yet another aspect of the invention, it is intended that this easily set up and easily collapsed box 20 can be repeatedly reused and recycled. For example, the box flats 26 can be provided at one or more packing stations. There, personnel can erect or set up the box into its configuration shown in FIG. 1. The box can then be filled with, for example, bagged packages of frozen foods such a frozen vegetables or other material. A top (not shown) can then be fastened across the top of the open box, and the box can be placed with other filled boxes on a pallet. The palletized boxes then can be shipped to a grocery store or other distribution facility. There, the top can be removed and the boxes placed upon, for example, frozen food display racks or other support structure in frozen food display facilities (not shown). In carrying out the invention, it is contemplated that the boxes can be provided in sizes which will snuggly mate or fit within the display racks. When the box 20 is empty, it can be removed from the display rack, cleaned if necessary, knocked flat as in accordance with the procedure described above, and shipped back to the original packing stations Although these corrugated plastic boxes 20 may initially cost somewhat more than boxes of similar size made of corrugated cardboard paper, the plastic boxes can be reused time and time again. The effective cost of reusing these novel boxes will fall, over a period of time, to an amount significantly less than the cost of single-use corrugated cardboard paper boxes of similar size and shape. Because the plastic boxes are reasonably attractive, they can be sized and shaped to be placed directly upon the display supports. Because they need not be unpacked, additional labor cost savings can be realized. Because the boxes are significantly stronger than comparable corrugated cardboard paper boxes, damage to the goods and to the boxes themselves is significantly reduced, thus further reducing the overall cost of using these boxes. The boxes have good stacking strength, and they do not degrade in humid or harsh environments. The constituent plastic and the finished boxes can be provided in virtually any desired color.

I claim:

1. A rigid corrugated plastic box, the box material comprising a series of substantially evenly spaced plastic corrugations;

the box comprising a plurality of box sides connected to one another at intermediate hinge lines, at least one of the box sides comprising a side panel and an upper panel being connected to and folded over against the inner surface of the side panel to form a strong, smooth vertical box side and a strong, smooth, top horizontal edge, and an end panel extending from one box side hinge;

said end panel having an L-shape and comprising an upper portion and a lower portion, the upper portion of the end panel being adapted to extend over a number of corrugations of an adjacent box side panel to which the L-shaped end panel can be affixed, and the lower portion of the end panel being adapted to extend over a substantially greater number of corrugations of said adjacent box side panel, whereby to avoid the concentration of bowing force and strain at any one side panel corrugation, the upper panel of one box side extending only partly over the side panel to which the upper panel is attached and being shaped to fit closely adjacent to the edges of the end panel L-shape upper portion and lower portion.

2. A rigid corrugated plastic box according to claim 1 further including a plurality of box upper panels are secured to the respective box sides so as to inhibit box side bowing caused by interior box loads.

3. A method of using a rigid corrugated plastic box, comprising the steps of:

erecting a box from a box blank; the box comprising a plurality of box sides connected to one another at intermediate hinge lines, at least one of the box sides comprising a side panel and an upper panel being connected to and folded over against the inner surface of the side panel to form a strong, smooth vertical box side and a strong, smooth, top horizontal edge, and an end panel extending from one box side hinge;

said end panel having an L-shape and comprising an upper portion and a lower portion, the upper portion of the end panel being adapted to extend over a number of corrugations of an adjacent box side panel to which the L-shaped end panel can be affixed, and the lower portion of the end panel being adapted to extend over a substantially greater number of corrugations of said adjacent box side panel, whereby to avoid the concentration of bowing force and strain at any one side panel corrugation, the upper panel of one box side extending only partly over the side panel to which the upper panel is attached and being shaped to fit closely adjacent to the edges of the end panel L-shape upper portion and lower portion;

filling the erected box with produce at a box filling point;

shipping the filled box to a distribution point;

emptying the box at the distribution point;

knocking down the emptied box into a flat configuration; and returning the flattened box to a filling point for reuse.

4. A method of using a rigid corrugated plastic box according to claim 3 wherein the step of erecting a box from a box blank comprises the steps of:

folding a first bottom flap into a position substantially perpendicular with the side wall to which the first flap is joined;

folding second and third bottom flaps located adjacent to the first flap and located opposite to one another into positions substantially perpendicular with the side walls to which the respective second and third flaps are joined;

folding a fourth bottom flap opposite to the first flap and adjacent to the second and third flaps into a position substantially perpendicular to the side walls to which the four flap is joined; and inserting a tab extending distally from the fourth flap into a slot space defined by edges of the first, second and third flaps so as to create a substantially continuous bottom panel connected to and oriented substantially perpendicularly to each of the box side panels.

5. A method of using a rigid plastic box according to claim 4 wherein the step of knocking down the emptied box comprises the steps of:

pushing said fourth panel inwardly and into the box into a position substantially adjacent to the box side to which the fourth flap is attached;

outwardly folding said second and third box panels;

outwardly folding said first box panel;

outwardly folding the fourth panel; and thereafter reconfiguring the box blank into a substantially flat configuration.

* * * * *